US006043804A

United States Patent [19]

Greene

[11] Patent Number: 6,043,804

[45] Date of Patent: Mar. 28, 2000

[54] COLOR PIXEL FORMAT CONVERSION INCORPORATING COLOR LOOK-UP TABLE AND POST LOOK-UP ARITHMETIC OPERATION

[75] Inventor: Spencer H. Greene, Palo Alto, Calif.

[73] Assignee: Alliance Semiconductor Corp., Santa Clara, Calif.

[21] Appl. No.: 08/828,187

[22] Filed: Mar. 21, 1997

[51] Int. Cl.[7] ..... G09G 5/04

[52] U.S. Cl. ..... 345/153; 345/155

[58] Field of Search ..... 345/154, 199, 345/153, 155, 431; 382/167

[56] References Cited

U.S. PATENT DOCUMENTS

| | | | |
|---|---|---|---|
| 5,331,439 | 7/1994 | Bachar | 358/500 |
| 5,381,180 | 1/1995 | Keith | 348/396 |
| 5,402,513 | 3/1995 | Schafer | 382/47 |
| 5,475,400 | 12/1995 | Sellers et al. | 345/199 |
| 5,506,604 | 4/1996 | Nally et al. | 345/154 |
| 5,510,852 | 4/1996 | Shyu | 345/154 |
| 5,559,954 | 9/1996 | Sakoda et al. | 345/153 |
| 5,604,514 | 2/1997 | Hancock | 345/153 |
| 5,671,022 | 9/1997 | Ishida | 345/154 |
| 5,726,682 | 3/1998 | Lum et al. | 345/154 |
| 5,808,630 | 9/1998 | Pannell | 345/154 |

OTHER PUBLICATIONS

*Computer Graphics Principles and Practice* (Second Edition), Foley, Vandam, Feiner and Hughes, Addison–Wesley Publishing Company, Inc., 1993, pp. 584–591.

*Primary Examiner*—Bipin H. Shalwala
*Assistant Examiner*—David L Lewis
*Attorney, Agent, or Firm*—Abdy Raissinia

[57] ABSTRACT

A color space converter (100) is disclosed. The color space converter includes an input data MUX (110), a first and second look-up table (LUT) (104 and 106), an arithmetic logic unit (ALU) (108), and an output MUX (112). In a standard indexed color look-up mode, indexed pixel data are coupled to the LUTs (104 and 106) each of which provides direct color data to the output MUX (112). Depending upon a control signal, the output MUX (112) couples one of the direct color lines to an output. In a color conversion mode, the LUTs (104 and 106) store conversion constants. Input pixel data of a first color space format is coupled to the LUTs (104 and 106) and the ALU (108). The resulting conversion constants output from the LUTs (104 and 106) are added with portions of the input pixel data in the ALU (108) to generate direct color data of a second color space format.

15 Claims, 5 Drawing Sheets

$$\begin{bmatrix} R \\ G \\ B \end{bmatrix} = \begin{bmatrix} 1 & 0 & 1.402 \\ 1 & -0.344 & -0.714 \\ 1 & 1.772 & 0 \end{bmatrix} \begin{bmatrix} Y \\ U \\ V \end{bmatrix}$$

FIG. 4a

| INDEX (U) | R | | B | | G | |
|---|---|---|---|---|---|---|
| | U * 0 | table entry | U * 1.772 | table entry | U * (-0.344) | table entry |
| 0x00 0 | 0 | 0 | 0 | 0 | 0 | 0 |
| 0x01 1 | 0 | 0 | 1.772 | 2 | -0.344 | 0 |
| 0x10 2 | 0 | 0 | 3.544 | 4 | -0.688 | -1 |
| ⋮ | ⋮ | ⋮ | ⋮ | ⋮ | ⋮ | ⋮ |
| 0x7e 126 | 0 | 0 | 223.272 | 223 | -43.344 | -43 |
| 0x7f 127 | 0 | 0 | 225.044 | 225 | -43.688 | -44 |
| 0x80 -128 | 0 | 0 | -226.818 | -227 | 44.032 | 44 |
| 0x81 -127 | 0 | 0 | -225.044 | -225 | 43.688 | 44 |
| 0x82 -126 | 0 | 0 | -223.272 | -223 | 43.344 | 43 |
| ⋮ | ⋮ | ⋮ | ⋮ | ⋮ | ⋮ | ⋮ |
| 0xfd -3 | 0 | 0 | -5.316 | -5 | 1.032 | 1 |
| 0xfe -2 | 0 | 0 | -3.544 | -4 | 0.688 | 1 |
| 0xff -1 | 0 | 0 | -1.772 | -2 | 0.344 | 0 |

FIG. 4b

COLOR PIXEL FORMAT CONVERSION INCORPORATING COLOR LOOK-UP TABLE AND POST LOOK-UP ARITHMETIC OPERATION

TECHNICAL FIELD

The present invention relates generally to graphics systems, and more particularly to computer graphics systems for providing a visual display from two or more pixel data types.

BACKGROUND OF THE INVENTION

Common computer graphics display hardware (typically a cathode ray tube or liquid crystal display monitor) generates an image from the three additive colors, red, green and blue (often referred to as "RGB" format). Digital video, in contrast, is commonly stored in luminance/chrominance format ("YUV" for example). Simultaneous display of RGB and YUV data on the same screen is a common application. It typically involves conversion of different source data formats to a common color space format (generally RGB for computer monitors).

It is known in the prior art to provide stand alone conversion specific hardware to a computer system to enable the conversion from one color space to another. Further, it is known to use stand alone converters having programmable parameters. Such applications, however, can increase system size and cost, and add to the complexity of the system board designs.

It is also known to use host resident software routines to convert between color spaces. Such routines are undesirable as they tie up valuable host resources.

U.S. Pat. No. 5,402,513 issued to John C. Schafer on Mar. 28, 1995, discloses a video window generator that includes a YUV-to-RGB conversion circuit. As shown in FIG. 6 of the patent, and described in column 8, the YUV-to-RGB circuit requires numerous multiply and divide circuits. Such circuits add to the complexity of the design and can occupy valuable space on an integrated circuit.

U.S. Pat. No. 5,381,180 issued to Michael Keith on Jan. 10, 1995, discloses an apparatus for generating color look-up table (CLUT) format video. As described in column 4 of the patent, video data is upsampled to a YUV888 format. The data is then truncated to YUV544 format, and this 13-bit form used as an index to a 8192 entry look-up table. Each entry in the look-up table corresponds to one of 256 values in an eight bit look-up table. A drawback of the Keith patent is that it requires a large look-up table and provides only a limited number of colors (256).

It is therefore desirable to provide a method and apparatus for accomplishing color space conversion that does not result in the above mentioned drawbacks.

SUMMARY OF THE INVENTION

It is an object of the present invention to provide a color conversion method and apparatus for a graphics display integrated circuit (IC) that does not require a large amount of additional hardware to implement, beyond that already used in the IC for other functions.

It is another object of the present invention to provide a color conversion method and apparatus that does not require a large amount of host resources (CPU time) to implement.

It is another object of the present invention to provide a color conversion method and apparatus that is easily adaptable to common raster graphics designs.

It is another object of the present invention to implement hardware color conversion and indexed-to-direct color look-up functions without use of multipliers, and with minimal hardware added to a basic CLUT circuit.

According to a preferred embodiment of the present invention, a color conversion system includes two memory look-up tables (LUTs), an arithmetic logic unit coupled the outputs of the LUT, and a LUT loading routine. In a standard indexed color mode, one or both of the LUTs are loaded with RGB data according to the particular application. According to well known techniques, an entry from one of the color tables is accessed according to an indexed pixel value and provides RGB data for an output device. In a color space conversion mode, the LUT entries are loaded with conversion multiply results that correspond to the particular index value associated with each LUT entry. A first portion of a first color space data is used to address the first LUT. At the same time, a second portion of the first color space data is used to address the second LUT. The outputs for each LUT and a third portion of the first color space data are coupled to the arithmetic logic unit. The arithmetic logic unit adds the multiply results to the third portion of the input color data to provide output color data of a second color space type.

An advantage of the present invention is that it takes advantage of hardware already required for other functions in some raster graphics systems, thereby reducing incremental cost of the color conversion function.

Another advantage of the present invention is that it can implement a variety of conversion operations to accommodate conversions between different color spaces.

Other objects and advantages of the present invention will become apparent in light of the following description thereof.

BRIEF DESCRIPTION OF THE DRAWINGS

FIG. 4*a* is a matrix illustrating a YUV to RGB conversion operation.

FIG. 4*b* illustrates selected LUT entries of the first look-up table for a YUV to RGB conversion operation.

DETAILED DESCRIPTION OF THE EMBODIMENTS

Figure 1:
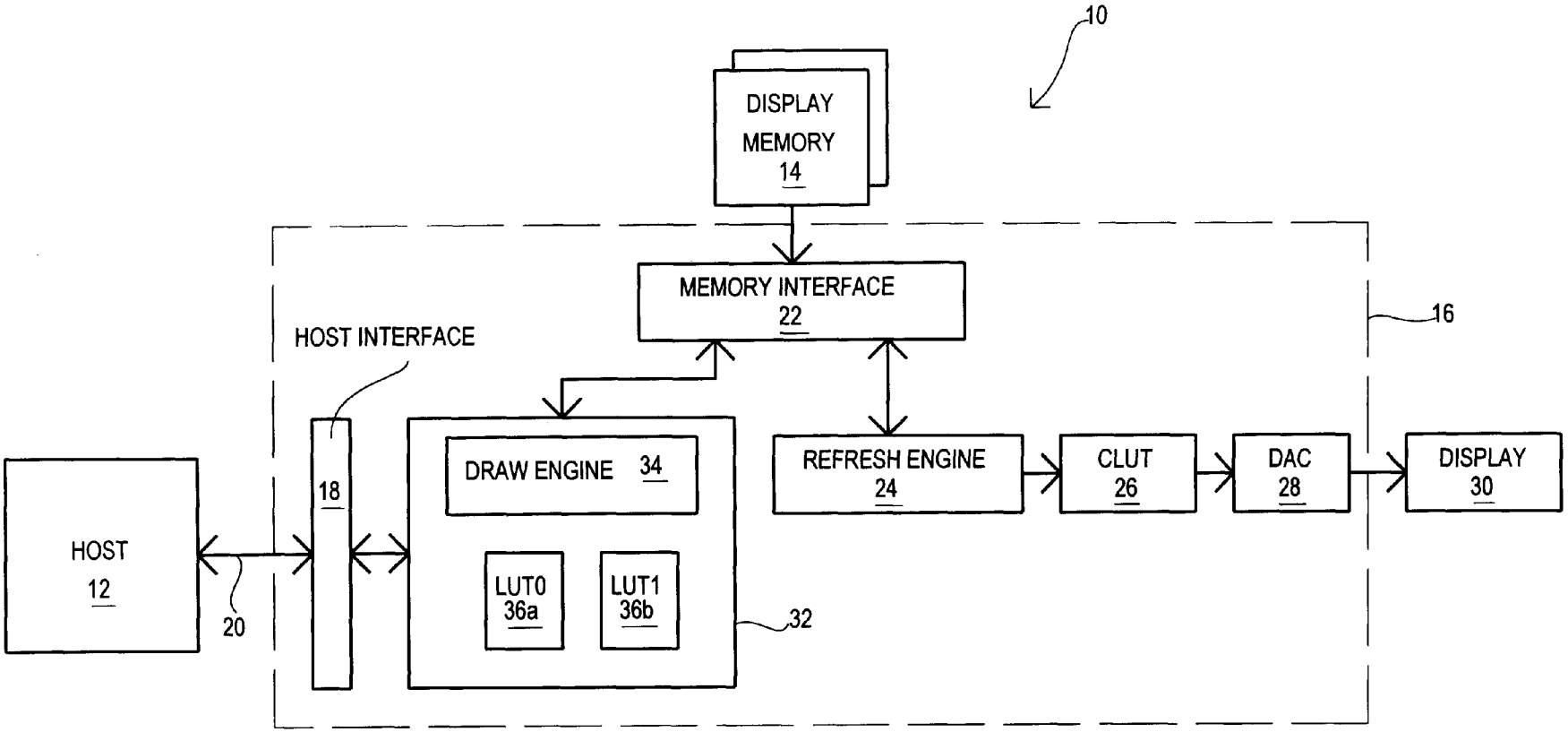
FIG. 1 is block diagram illustrating a computer graphics system incorporating the preferred embodiment.

FIG. 1 sets forth, generally, a computer graphics system employing a color space converter according to one embodiment of the present invention. The graphics system is designated by the general reference character 10 and includes a system host 12, a system display memory 14, and a graphics controller integrated circuit 16. The graphics controller 16 is coupled to the host 12 by a host interface circuit 18. The host 12 controls the operation of the graphics controller 16, including reading and writing data to and from the graphics controller by placing commands and/or data on the host bus 20. The host interface circuit 18 is conventional in nature and not critical to the description of the present invention, and so will not be discussed in any further detail herein.

The graphics controller 16 is also coupled to the display memory 14 by a memory interface 22. The memory interface 22 provides the control and address signals necessary to access data stored in the display memory 14. The display memory 14 stores the current display image as a collection of pixel data, including data stored in a plurality of color space formats. Designation of color format and memory address for different areas of the display is accomplished according to well-known schemes, such as window detection, "colorkey" and "chromakey" methods. The display data within the display memory 14 are continuously shifted out to a display device by operation of the refresh engine 24 which reads frames of display data. Data from the refresh engine 24 are coupled to a color look-up table (CLUT) 26 which converts indexed pixel data into direct color format (commonly RGB). The CLUT output data is coupled to a digital-to-analog converter (DAC) 28 which converts the digital CLUT output data into analog display voltages, which drive the display 30. Integral to the graphics controller is the graphics engine 32. The graphics engine 32 is shown to include a draw engine 34, which may include two look-up tables 36*a* and 36*b* for palettized texture lookup or other functions. The preferred embodiment integrates a color space converter function into the graphics engine 32.

Figure 2:
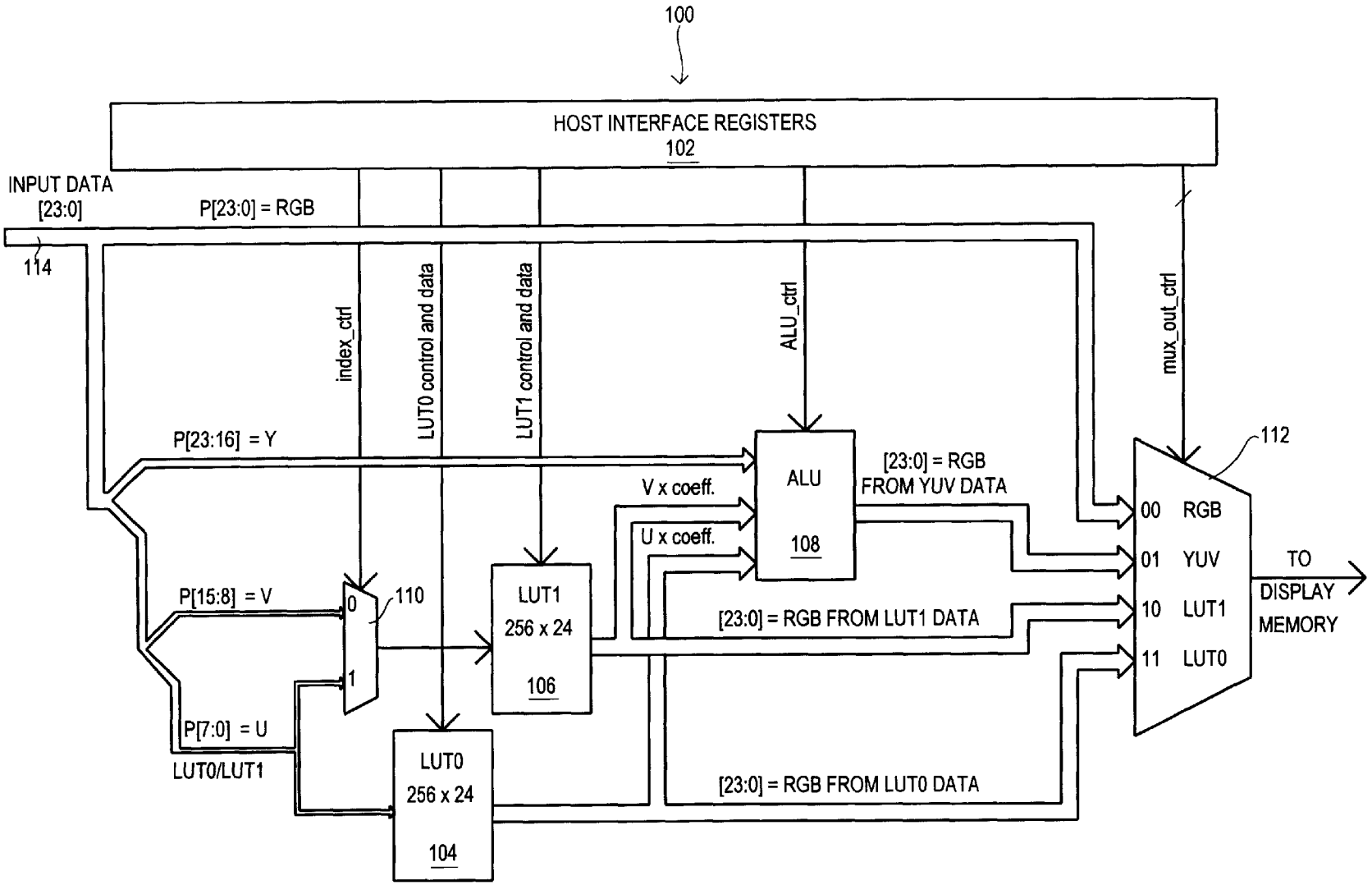
FIG. 2 is a block schematic diagram illustrating the color converter according to the present invention.

The color space converter 100 according to the preferred embodiment is set forth in FIG. 2, and generally includes a number of host interface registers 102, a first programmable look-up table (LUT0) 104, a second programmable LUT (LUT1) 106, an arithmetic logic unit (ALU) 108, an input multiplexer (MUX) 110, and an output multiplexer (MUX) 112. The operation of the LUTs (104 and 106), ALU 108, and MUXs (110 and 112) are dependent upon values loaded into the host interface registers 102. Pixel data are placed on an internal data bus 114, and selectively coupled to the LUTs (104 and 106), ALU 108, and/or output MUX 110 according to the host interface register 102 values. The particular embodiment set forth in FIG. 2 can accommodate pixel input data in a variety of different formats. For example, 24-bit input data can be 24-bit RGB, 24-bit YUV, or 8 bit indexed (color look-up table 8-bit, or CLUT8). In the event the input data is 24-bit RGB, all 24 bits of the pixel data are passed directly through output MUX 112. For CLUT8 data, the 8-bits of pixel data [7:0] are coupled either to LUT0 104 or LUT1 106 by operation of input MUX 110. The operation of the input MUX 110 is controlled by the signal "index_ctrl", the value of which is dependent upon the host interface register values. The appropriate LUT output is passed through output MUX 112. For 24-bit YUV data, the lower eight bits [7:0], representing the "U" component of the pixel, are coupled to LUT0 104. The middle eight bits [15:8], representing the "V" component of the pixel, are coupled to LUT1 106. The upper eight bits [23:16], representing the "Y" component of the pixel are coupled to the ALU 108.

As is well understood in the art, each LUT (104 or 106) has a number of entries, with each entry corresponding to a particular eight bit index value. When an eight bit index value is received by the LUT (104 or 106) the corresponding table entry contents are output by the LUT (104 or 106). In the present invention, the LUT (104 and 106) contents are programmable, with the host interface 18, under the control of a host resident routine, loading data into the LUT entries. In the preferred embodiment, memory mapped control registers in the graphics controller 16 are used to enable writes to either LUT (104 or 106).

The outputs of the first and second LUTs (104 and 106) are coupled to first and second inputs of the ALU 108 and the output MUX 112. A third input to the ALU 108 is provided by the upper eight bits [23:16] of pixel data from the internal data bus 114, corresponding to the Y color component. The ALU 108 also receives the control input signal "alu_ctrl". In response to the "alu_ctrl" signal the ALU 108 provides a conversion output that is the sum of selected input signals. In the preferred embodiment, the pixel data is in 24-bit RGB format (shown as "[23:0]=RGB from YUV data." This data is the output of the conversion circuit and is passed through output MUX 112 when the conversion mode is selected.

In a standard indexed (i.e., non-color conversion) mode, a first set of palette data, representing the possible colors of one display window, is loaded into the first LUT 104 while a second set of palette data, representing the possible colors of a second display window, may be optionally loaded into the second LUT 106.

In a color conversion mode, a different type of data is loaded into the LUTs (104 and 106). Instead of palette data, each LUT (104 and 106) is loaded with color conversion constants that depend on the particular color conversion operation to be performed. In the preferred embodiment, all conversions are performed from a non-RGB format to RGB format. The nature of the conversion data will be discussed in more detail below.

Figure 3A:
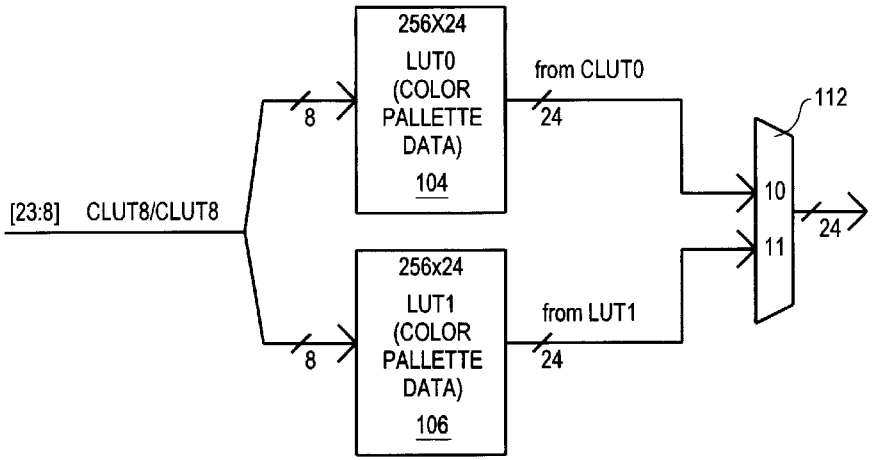
FIG. 3*a* is a block diagram illustrating the operation of the present invention in a standard color look-up mode.

FIG. 3*a* is block schematic diagram illustrating the standard indexed mode of a preferred embodiment. In the standard indexed mode, the input data MUX 110 index_ctrl is high, and the lower eight bits of data [7:0] are coupled to both LUT0 104 and LUT1 106. A given CLUT8 value is applied to both LUTs (104 and 106), and each LUT produces a 24-bit RGB output value. The output MUX 112 under the control of the "mux_out_ctrl" signal, outputs either the 24-bit LUT0 or LUT1 RGB data. The mux_out_ctrl signal is dependent upon values stored in the host interface registers 102.

Figure 3B:
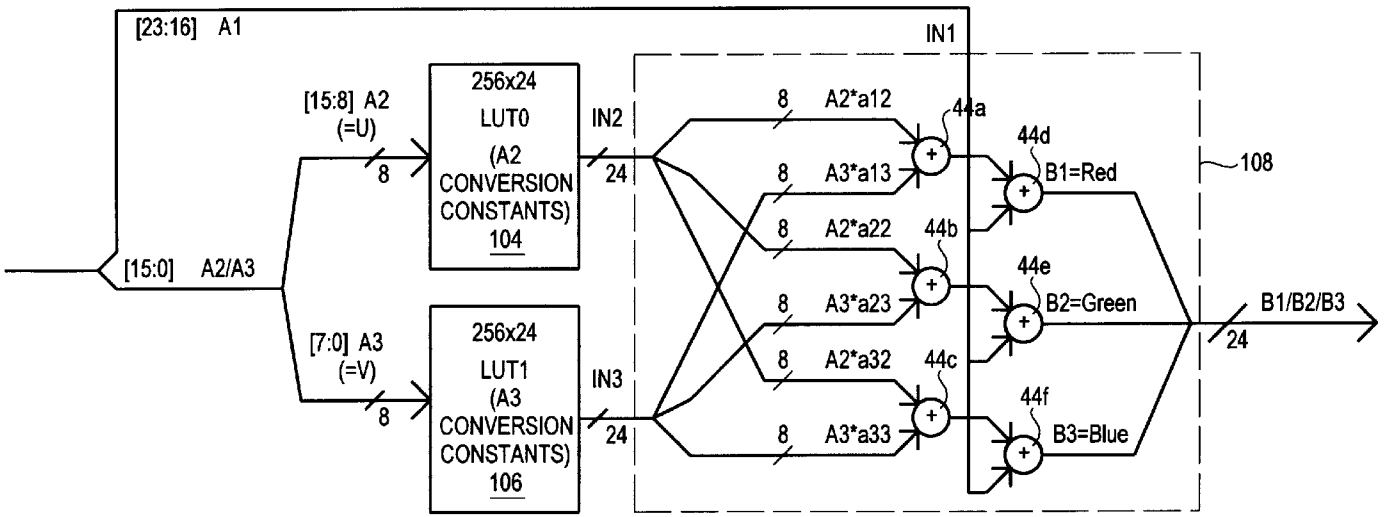
FIG. 3*b* is a block diagram illustrating the operation of the present invention in a color conversion mode.

FIG. 3*b* is block schematic diagram illustrating a color conversion mode according to one embodiment. The embodiment of FIG. 3*b* assumes that pixels of the input color space format have three components (A1, A2 and A3) and pixels of the desired output color space format also have three components (B1, B2 and B3). Further, the relationship between the input color space and the desired color space is expressed by the matrix $$\begin{bmatrix} B1 \\ B2 \\ B3 \end{bmatrix} = \begin{bmatrix} 1 & a_{12} & a_{13} \\ 1 & a_{22} & a_{23} \\ 1 & a_{32} & a_{33} \end{bmatrix} \begin{bmatrix} A1 \\ A2 \\ A3 \end{bmatrix}.$$

In the particular example set forth, the input color components A1, A2 and A3 correspond to Y, U and V, and the output components B1, B2 and B3 correspond to red, green and blue; but other color formats could also be used. As illustrated in FIG. 3*b*, in the color conversion mode, the first component of the input pixel (A1) is coupled to one input of the ALU 108. The second component of the input pixel (A2) is coupled to the second LUT 106 by operation of input data MUX 110. The third component of the input pixel (A3) is coupled to the first LUT 104.

As described above, in the color conversion mode, the LUTs (104 and 106) have been pre-loaded with conversion multiply constants. In the embodiment of FIG. 3*b*, the values of the input pixel components (A2 and A3 ) are used as indexes for the same value multiplied by its associated matrix elements. Thus, the input value of the second LUT 106 (A2) indexes a LUT entry storing the values $a_{12}$*A2, $a_{22}$*A2, and $a_{23}$*A2, for all 256 possible values of A2. Similarly, the first LUT 104 conversion data is such that its respective input value (A3) indexes LUT output data equivalent to $a_{13}$*A3, $a_{23}$*A3, and $a_{23}$*A3. The LUT output values, which correspond to the inputs multiplied by appropriate coefficients, are provided as further inputs to the ALU 108.

The ALU 108 of FIG. 3b is shown to include six, two input saturation adders (44*a–f*). As well understood in the art, the saturation adders (44*a–f*) perform an add operation that includes a ceiling value (i.e., if the adders provide a eight bit output, the maximum output value is 255). The resulting output of the first three saturation adders (44*a–c*) are provided as inputs to the second three saturation adders (44*d–f*). Further, the first input pixel component (A1) is provided as the second input to each of the second saturation adder (44*d–f*). The resulting outputs of the second saturation adders (44*d–f*) are the components of a pixel in the desired output color space format (B1, B2, B3).

One skilled in the art would recognize that the embodiment of FIG. 3*b* sets forth only one particular conversion arrangement, and the structure illustrated is subject to considerable variation. For example, the relationship between color spaces need not be a linear one. Conversion constants could be loaded into the LUTs (104 and 106) to perform a non-linear color space conversion. In addition, the adder circuit 32 could be simplified as the majority of common color conversion operations do not require a three value add operation since several of the matrix elements are zero. It is also important to note that conversion can be made dynamic by occasionally loading new LUT values to change the conversion. In this manner, color conversion can be optimized to user preference. Accordingly, the structure shown in FIG. 3*b* should not be construed to unnecessarily limit the scope of the present invention.

The operation of the preferred embodiment, which converts 24-bit YUV data to 24-bit RGB data will now be described in detail.

A twenty-four bit YUV input is received on internal data bus 114. The Y component is directly coupled to the ALU 108. The V component is coupled to the second LUT 106. The U component is coupled to the first LUT 104. It is understood that the Y value is a luminance value of the input first pixel, while U and V are chrominance values.

The particular conversion operation of YUV to RGB data is best described with reference to FIGS. 4*a* and 4*b*. FIG. 4*a* is a matrix equation defining gamma corrected YUV to RGB conversion. FIG. 4*b* illustrates the particular entries loaded into the first LUT 104 to accomplish the conversion. Eleven entries of the first LUT 104 are shown in FIG. 4*b*; those for index values 0–2, 126–130, and 253–255. In parentheses next to each index value is the corresponding U value. The corresponding U values are in two's complement notation. In the particular YUV format illustrated, the U and V values range from −128 to +127 for pixel values of 00H to FFH. For the particular conversion being described, each LUT entry actually consists of three values, each value equivalent to its associated U value (or V value, in the case of the second LUT 106) multiplied by a matrix element. Because chrominance values are used to index the LUT, for the case of the first LUT 104, each entry represents the values U*(0), U*(1.772) and U*(−0.344). The values of the second LUT 106 obviously follow from the matrix of FIG. 4*a* and the entries illustrated in FIG. 4*b*.

One skilled in the art would recognize that for the YUV-RGB conversion described, the ALU 108 could vary from that set forth in FIG. 3*b*. Fewer add operations are required because the generation of the R and B components of the desired RGB format require only the luminance value and one chrominance value (reflected by the zero elements in the matrix of FIG. 4*a*). Accordingly, saturation adders 44*a* and 44*b* could be eliminated, if flexibility in conversion is sacrificed to gain a more compact ALU design.

Referring now to FIG. 3*b* in conjunction with FIG. 4*a* and 4*b*, it is illustrated that in the color conversion mode, the 24-bit output of first LUT 104 is split to provide a first conversion value (U*0) to a first of the 8-bit, signed saturation adders 44*a*. A second conversion value (U*1.772) is provided to a second of the 8-bit adders 44*b*. A third conversion value (U*(−0.344)) is provided to eight bit adder 44*c*. In a similar fashion, the 24-bit value from the second LUT 106 is split to provide a first of the stored conversion values (V*1.402) to adder 44*a*, a second value (V*0) to adder 44*b*, and a third value (V*1.402) to adder 44*c*. The resulting signed, saturation sums from adders 44*a*–44*c* are coupled as inputs to signed, saturation adders 44*d*–44*f*.

Concurrently, the luminance value is coupled as a second input to adders 44*d–f*. In this manner the outputs of adders 44*d–f* are eight bit additive red, green and blue components, respectively, of a 24-bit RGB pixel. It is noted that the 8-bit adders (56*a–d*) are responsive to the sign bit of each conversion value stored in the look-up table. It is also noted that in the event more precision in any given color conversion operation is desired, wider adders (such as 10-bit or 12-bit) and deeper LUT entries could be implemented. For example, in the case where one of the conversion multipliers is zero (as in the case of the U and V components in the YUV-RGB conversion described) the LUTs (104 and 106) could store two conversion values as opposed to three.

Figure 5B:
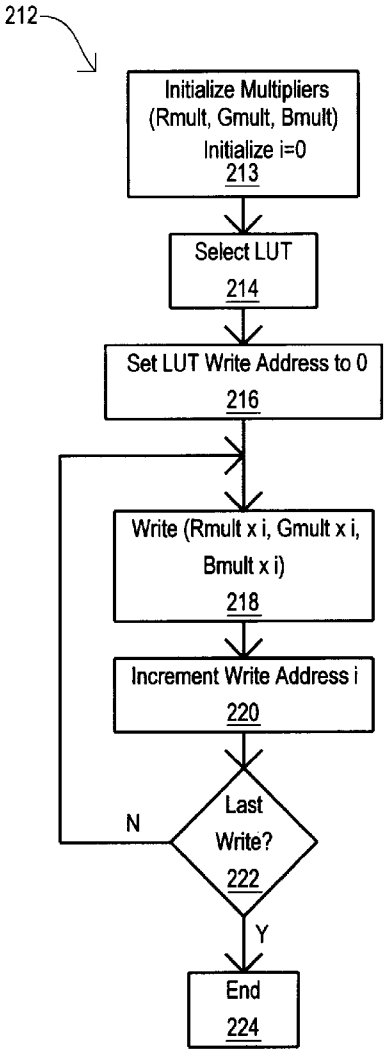
FIG. 5*b* is a flow diagram illustrating the LUT loading routine for the color conversion operation according to the present invention.
Figure 5A:
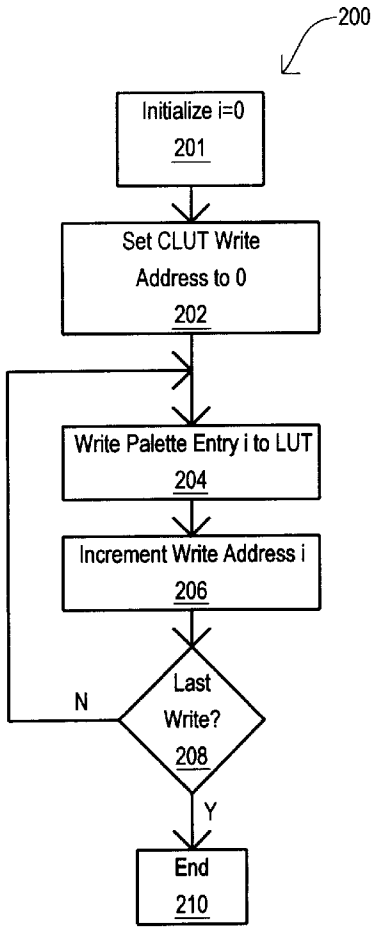
FIG. 5a (PRIOR ART)
FIG. 5*a* is a flow diagram illustrating the LUT loading routine for loading LUT data for a standard color look-up mode.

FIGS. 5*a* and 5*b* set forth LUT loading routines. FIG. 5*a* illustrates the conventional CLUT loading routine, designated by the general reference character 200. According to well-known techniques a CLUT write address is loaded into the graphics engine (202). This is typically accomplished by a host write to input/output (I/O) mapped or memory mapped register. In the preferred embodiment it is one of the host interface registers (as shown in FIG. 2). Direct color palette data is then written to indexed locations (204). The write address is then incremented (206) to access the next indexed location. In the event the next location is to be written to, another set of three consecutive writes take place. In the event the previous write was the last write, the routine ends (208 and 210). The above referenced CLUT loading routine, or palette loading routine is conventional.

FIG. 5*b* illustrates the LUT loading routine for a color conversion operation according to the present invention. The routine is designated by the general reference character 212 and begins with the initialization of the multiplier values (213). For example, in the case of the YUV to RGB conversion set forth in FIGS. 4*b*, the multiplier values would be R multiplier values (Rmult) of 0 and 1.402, G multiplier values (Gmult) of −0.344 and −0.714, and B multiplier values (Bmult) of 1.772 and 0. The first or second LUT is then selected (214). This is accomplished via a host write to an I/O mapped register. Both LUTs must be loaded to enable color conversion, hence procedure 212 will be executed twice before color conversion begins. In the case of the architecture of FIG. 2, the host write will enable one of the LUTs (104 and 106) to receive control signals and data via the LUT0 or LUT1 "control and data" lines. For example, when U constants are to be loaded, LUT0 104 would be selected. For the V data, LUT1 106 would be selected. A write address for the selected LUT is then set (216). With the particular LUT indexed location now selected, the appropriate constants (Rmult x i, Gmult x i, Bmult x i) are written for that location (218). In the case of the YUV to RGB conversion described above, LUT0 104 would be loaded with the values shown in FIG. 4*b*. The routine then continues in the same manner as the conventional CLUT routine. The write address is incremented (220), and the write operation continues in the next indexed location, or concludes (222 and 224).

It is understood that the detailed description and figures presented are but a few embodiments the present invention, and that the invention may be changed, and other embodiments derived, without departing from the spirit and scope of the invention. As just one example, the location of the color space converter as set forth in FIG. 1, should not be construed as limiting the invention. The color space converter could also be situated after the refresh engine. Accordingly, the invention is intended to be limited only by the appended claims.

What is claimed is:

1. A color space converter capable of functioning in a standard indexed mode or a color conversion mode comprising:

at least one LUT, having a plurality of color space conversion constants, for receiving pixel data of a first color space type and generating intermediate format data therefrom; and arithmetic logic means for combining the intermediate format data to generate pixel data of a second color space type;

a multiplexer for receiving the pixel data of a first color space type, the intermediate format data and the pixel data of the second color space type as its inputs and selectively outputting one of said inputs.

2. The color space converter of claim 1, wherein:

the first color space type includes luminance values, first chrominance values, and second chrominance values for each pixel.

3. The color space converter of claim 2 wherein:

the second color space type includes a plurality of color components.

4. The color space converter of claim 2 wherein:

said at least one LUT receives at least first chrominance values and generates therefrom intermediate format data equivalent to the first chrominance values multiplied by at least one conversion factor; and said arithmetic logic means combines the intermediate format data with luminance values.

5. The color space converter of claim 4, wherein:

said at least one LUT generates intermediate format data that includes first conversion constants that are equivalent to first chrominance values multiplied by a first conversion factor, and second conversion constants that are equivalent to the first chrominance values multiplied by a second conversion factor; and said arithmetic logic means combines the first conversion constants with luminance values, and the second conversion constants with the luminance values.

6. The color space converter of claim 5, wherein:

said at least one LUT further receives second chrominance values, said intermediate format data further including third conversion constants equivalent to the second chrominance values multiplied by a third conversion factor, and fourth conversion constants that are equivalent to the second chrominance values multiplied by a fourth conversion factor; and said arithmetic logic means combines the first conversion values with luminance values to generate first color components, combines the second and third conversion values with the luminance values to generate second color components, and combines the fourth conversion values with the luminance values to generate third color components, the first, second and third color components being combined to represent single colors.

7. The color space converter of claim 1, wherein:

the first color space type is YUV.

8. The color space converter of claim 1, wherein:

the first color space type is YIQ.

9. The color space converter of claim 1, wherein:

the first color space type is YCrCb.

10. The color space converter of claim 1, wherein:

the second color space type is RGB.

11. The color space converter of claim 1, wherein:

the first color space type is YUV; and the second color space type is RGB.

12. In a computer graphics system, a combination for functioning in either a standard indexed mode or a color space conversion mode, comprising:

at least one look-up table (LUT) having a plurality of storage locations, an input for receiving an index value, and an output for providing a content of a particular storage location according to the index value;

means for programming the at least one look-up table with selected pixel color values in the standard indexed mode, and for programming the look-up table with conversion constants in the conversion mode; and at least one adder circuit for receiving values on two inputs and generating a sum thereof, one of the values being the output of said at least one LUT.

13. The combination of claim 12, wherein:

said at least one LUT includes a first LUT and a second LUT; and said means for programming programs the first LUT with a first set of conversion constants in the conversion mode, and programs the second LUT with a second set of conversion constants in the conversion mode.

14. The combination of claim 12, wherein said at least one LUT includes a first and a second LUT.

15. In a computer graphics system having at least one programmable color look-up table (LUT) having a standard mode of operation wherein the LUT includes a plurality of entries addressable by a particular indexed pixel value, each LUT entry storing a programmable pixel color value, a method of converting pixels of a first color space to a second color space, comprising the steps of:

(a) pre-loading each LUT entry with a conversion constants that is equivalent to a function of the particular indexed pixel value corresponding to the LUT entry;

(b) addressing the at least one LUT with chrominance data; and (c) adding the resulting LUT conversion constant to luminance data.

* * * * *